United States Patent [19]

Kahler

[11] 4,187,885

[45] Feb. 12, 1980

[54] THREE-POINT, PLUG TYPE SEALING MEANS FOR A HOLLOW, CYLINDRICAL CONTAINER, PARTICULARLY A LIQUID-FILTERED SMOKING DEVICE

[76] Inventor: Richard W. Kahler, Rte. 1, Box 61, Rock Cave, W. Va. 26234

[21] Appl. No.: 854,033

[22] Filed: Nov. 22, 1977

[51] Int. Cl.[2] ..... B65D 59/06; A24F 1/14; A24F 1/30

[52] U.S. Cl. ..... 138/89; 131/173; 138/96 R; 220/69; 220/256; 220/306; 220/355

[58] Field of Search ..... 131/231, 235 R, 235 ST, 131/236, 173; 220/69, 306, 256, 352, 355; 215/100.5; 285/331; 403/248, 251, 277, 332; 248/359, 346, 146; 138/89, 96 R

[56] References Cited

U.S. PATENT DOCUMENTS

| | | | |
|---|---|---|---|
| 2,004,627 | 6/1935 | Hoeflich | 248/346 X |
| 2,336,185 | 12/1943 | Moran | 248/346 X |
| 2,628,840 | 2/1953 | Laube, Jr. | 220/69 X |
| 2,644,978 | 7/1953 | Becker | 403/332 X |
| 2,805,017 | 9/1957 | Hill et al. | 248/346 X |
| 2,984,381 | 5/1961 | Bennett | 220/306 |
| 3,051,303 | 8/1962 | Daanen et al. | 220/69 X |
| 3,317,069 | 5/1967 | Chin | 248/346 X |
| 3,583,710 | 6/1971 | Burelle | 138/89 X |
| 3,612,343 | 10/1971 | Phipps | 220/69 |
| 3,661,184 | 5/1972 | Lachenmayer | 138/96 R X |
| 3,744,528 | 7/1973 | Vestal | 138/96 R X |
| 4,029,109 | 6/1977 | Kahler | 131/173 |
| 4,031,904 | 6/1977 | Karl | 131/173 |
| 4,042,143 | 8/1977 | Biggins | 220/256 |

FOREIGN PATENT DOCUMENTS

| | | | |
|---|---|---|---|
| 1131577 | 2/1957 | France | 220/69 |

*Primary Examiner*—Allan N. Shoap
*Attorney, Agent, or Firm*—Schwartz & Weinrieb

[57] ABSTRACT

A seal device includes a first, inverted cup-shaped member and a second cup-shaped member within which the first member is disposed. The open, lower end of the first member is provided with a radially outwardly projecting annular flange for engaging the inner peripheral wall of the second member whereby a blind, annular recess is defined by the first and second members for accommodating one end of a hollow container. The peripheral walls of the seal members, as well as the flange of the first member, thus engages at least two primary surfaces of the container thereby defining a three-point, plug type seal therefor. The second member is also provided with a frusto-conical skirt portion which serves as a base or foundation for the container, and if desired, the first and second members may be integrally formed.

5 Claims, 4 Drawing Figures

THREE-POINT, PLUG TYPE SEALING MEANS FOR A HOLLOW, CYLINDRICAL CONTAINER, PARTICULARLY A LIQUID-FILTERED SMOKING DEVICE

FIELD OF THE INVENTION

The present invention relates generally to sealing devices, and more particularly to a seal which is particularly adapted for use in conjunction with liquid-filtered smoking devices for preventing leakage of the liquid therefrom.

BACKGROUND OF THE INVENTION

It has been observed in connection with prior art liquid-filtered smoking devices or water pipes that due to the variance in the pressure prevailing within the devices during, for example, the inhalation and exhalation operative periods, or during inhalation and non-inhalation operative periods, the water within the pipes tends to surge and splash. As a result, as prior art smoking devices are normally provided with conventional two-point cut-type seals, the water within such devices tends to leak out therefrom within a relatively short period of operative use.

More particularly, as may be appreciated from FIG. 1, a smoking device container 12 is provided with a conventional two-point, cup-type seal 14 which is disposed upon the lower, open end of container 12 so as to retain a liquid within the container. Seal 14 is considered to be a two-point type sealing means because the seal only contacts the container 12 along two major surfaces, that is, along the bottom, peripheral edge 16 defining the lower, open end of container 12, and along the lower, outer peripheral side wall 18.

As noted hereinabove, as a result of the variable pressures prevailing within the smoking devices, the bottom wall of the seal 14 tends to periodically separate from the peripheral edge 16 of container 12 with the result that the liquid contained within container 12 is forced into the space defined between peripheral edge 16 and the bottom wall of seal 14, such pressures acting, in effect, as a pumping means. Under continued use, the pumping pressures continue to force the liquid into the defined space whereby the liquid is eventually conducted upwardly between the peripheral side wall of the seal 14 and the peripheral side wall 18 of container 12. The liquid ultimately leaks out from the sealed lower end of container 12, as a result of which, the environment surrounding the liquid pipe becomes wet. Such results are obviously undesirable and render such prior art smoking devices, provided with such conventional seal means, commercially unacceptable.

OBJECTS OF THE INVENTION

Accordingly, it is an object of the present invention to provide a new and improved sealing means.

Another object of the present invention is to provide a new and improved sealing means which overcomes the various disadvantages and drawbacks characteristic of prior art sealing means.

Still another object of the present invention is to provide a new and improved sealing means which can be used in conjunction with any cylindrical container for sealing an open end thereof.

Yet another object of the present invention is to provide a new and improved sealing means which can be used in conjunction with any cylindrical conduit having a liquid disposed therein.

Still yet another object of the present invention is to provide a new and improved sealing means which is particularly adapted for use with liquid-filtered smoking devices.

Yet still another object of the present invention is to provide a new and improved sealing means which is simplified in structure.

A further object of the present invention is to provide a new and improved sealing means which is economical to produce.

A still further object of the present invention is to provide a new and improved sealing means which is easily applied to and removed from a conduit to be sealed.

A yet further object of the present invention is to provide a new and improved sealing means which will facilitate the cleaning of the container with which the same is operatively engaged.

An additional object of the present invention is to provide a new and improved sealing means which is also provided with means for supporting the container in an upstanding operative mode.

SUMMARY OF THE INVENTION

The foregoing and other objects are achieved in accordance with the present invention through the provision of a sealing means which comprises a first, inverted cup-shaped member and a second cup-shaped member within which the first member is disposed. The open, lower end of the first member is provided with a radially outwardly projecting annular flange which is adapted to engage the inner peripheral wall of the second member whereby a blind, annular recess is defined between the inner peripheral wall of the second member and the outer peripheral wall of the first member. The lower end of the conduit is disposed within the annular recess with the peripheral edge of the conduit defining the lower, open end thereof preferably being seated upon the flanged portion of the first member. In this manner, the outer peripheral wall and flange of the first member, together with the inner peripheral wall of the second member, define a three-point, plug-type seal. The second seal member is preferably provided with a frusto-conical skirt portion which supports the container in a stable manner, and in accordance with another embodiment of the present invention, the first and second members may be integrally formed together.

BRIEF DESCRIPTION OF THE DRAWINGS

Various other objects, features, and attendant advantages of the present invention will be more fully appreciated as the same becomes better understood from the following detailed description when considered in conjunction with the accompanying drawings, in which like reference characters designate like or corresponding parts throughout the several views, and wherein.

DETAILED DESCRIPTION OF THE ILLUSTRATED EMBODIMENTS

Figure 2:
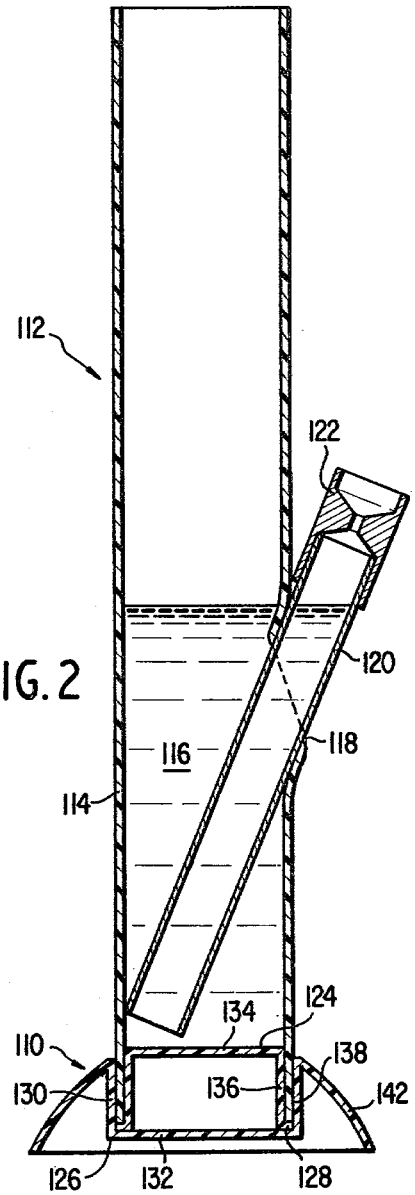
FIG. 2 is a cross-sectional view of a first embodiment of a three-point, plug type sealing means constructed in accordance with the present invention and mounted upon a liquid-filtered smoking device.
Figure 3:
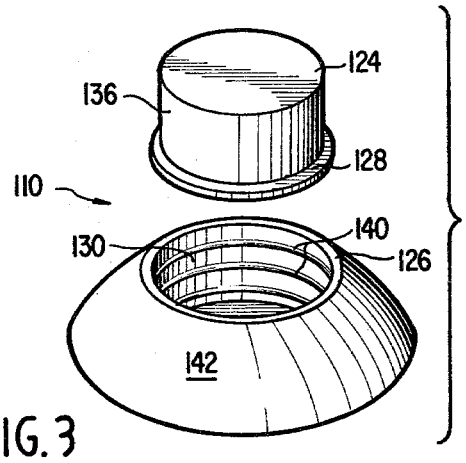
FIG. 3 is an exploded view of the sealing means of FIG. 2.

Referring now to the drawings, and more particularly to FIGS. 2 and 3 thereof, a sealing means constructed in accordance with the present invention is generally indicated by the reference character 110 and is seen to be particularly adaptable for use in conjunction with a liquid-filtered smoking device generally indicated by the reference character 112. The smoking device comprises a hollow, cylindrical, upstanding conduit or container 114 which is open at both ends thereof, and the sealing means 110 is mounted upon the lower end of the conduit or container. In this manner, a predetermined amount of liquid 116, such as, for example, water, may be retained within the conduit or container 114.

An aperture 118 is provided within a sidewall portion of the container 14, and a tubular member 120, open at both ends thereof, is inserted through aperture 118 such that the lower end of member 120 is disposed inwardly of container 114 and is immersed within liquid 116, while the upper end of member 120 projects outwardly of said conduit or container 114. A smoking bowl 122, which is preferably reversible, is removably disposed upon the upper end of member 120, the bowl serving to contain a predetermined amount of tobacco.

With particular reference now being made to the sealing means 110 of the present invention, it is seen that the seal comprises a first, inverted cup-shaped member 124 and a second, cup-shaped member 126. The lower, peripheral edge of member 134 defining the open end thereof is provided with a radially outwardly projecting annular flange 128, and the diametrical extent of flange 128 is substantially the same as the inner diameter of the peripheral wall 130 of member 126 so as to define a friction fitting therewith when member 124 is disposed internally of member 126.

The second member 126 is of course closed at the lower end thereof by means of a bottom walll 132, and the same limits the depth to which the first member 124 may be inserted into member 126. The first member 124 is similarly closed at the upper end thereof by means of an upper wall 134 which serves to define the bottom of the compartment of container 114 within which the liquid 116 is disposed.

As a result of the disposition of flange 128, and the relative disposition of the peripheral wall 136 of member 124 and peripheral wall 130 of member 126, a blind, annular space or recess 138 is defined within the seal means 110 for accommodating the lower end of container 114 in a friction-fit manner. It is thus readily appreciated that the sealing means of the present invention provides a three-point, plug type sealing means for the container 114 due to the fact that the sealing means 110 engages the container 114 along at least two primary surfaces.

Figure 1:
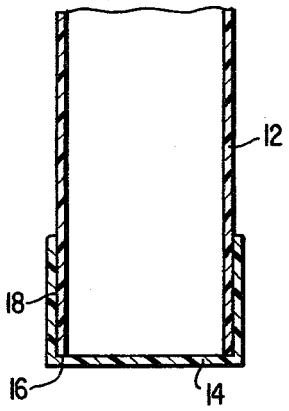
FIG. 1 PRIOR ART
FIG. 1 is a cross-sectional view of a conventional two-point, cup-type sealing means operatively mounted upon a container.

More particularly, the outer peripheral surface of peripheral side wall 136 of seal member 124 engages the inner peripheral surface of the lower end of container 114, and the inner peripheral surface of peripheral side wall 130 of seal member 126 engages the outer peripheral surface of the lower end of container 114 optionally, the upper surface of flange 128 engages the lower peripheral edge 150 of container 114. When liquid pressure forces act upon the upper wall 134 of seal member 124, the same is not readily separated from container 114 in a manner noted with respect to prior art two-point seals depicted in FIG. 1 and discussed hereinabove, due to the fact that axial reinforcement is provided by peripheral wall 136. Still further, the second member 126 also resists such separation tendencies due to the friction fitting established with the first member 124 and container 114. Consequently, superior sealing results are obtained with the sealing means of the present invention as compared to the results achieved with conventional two-point seals.

In order to increase the friction-fitting and sealing characteristics of the assembled seal means 110 still further, and to retain the members 124 and 126 in their assembled state, the inner peripheral surface of peripheral wall 130 of member 126 may be provided with radially inwardly projecting annular ridges or beads 140. Both of the seal members 124 and 126 are fabricated of somewhat flexible and resilient synthetic plastic material, and when the member 124 is inserted within member 126, the flanged portion 128 of member 124 will merely ride over the ridges or beads 140 of member 125 such that member 124 is inserted within member 126 in a snap-fit manner.

It is further noted from FIGS. 2 and 3 that seal member 126 is also provided with a frusto-conical skirt 142 which has a depth greater than that of peripheral side wall 130. In this manner, skirt 142 serves as a stable foundation or base for supporting the smoking device in its upstanding operative mode.

Figure 4:
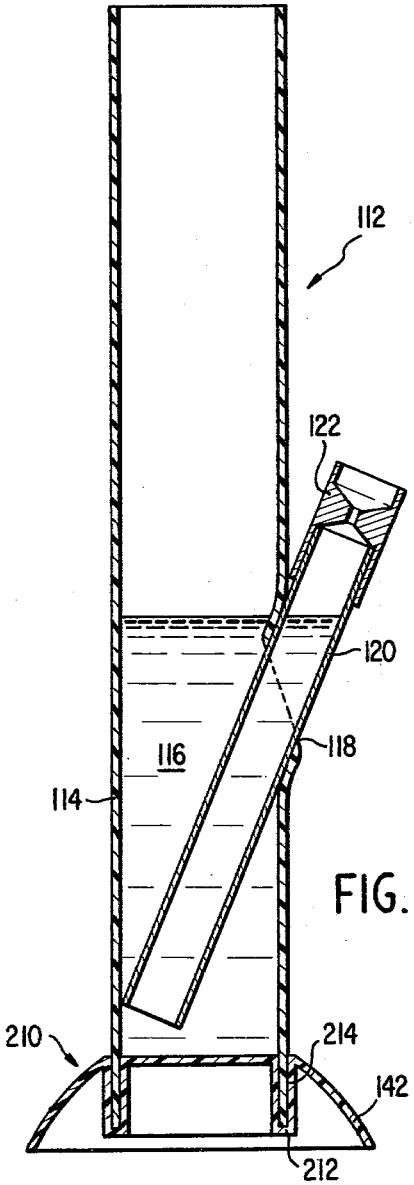
FIG. 4 is a view similar to that of FIG. 2, showing however another embodiment of a three-point, plug type sealing means constructed in accordance with the present invention.

Referring now to FIG. 4, a second embodiment of the present invention is disclosed wherein the seal members 124 and 126 have been integrally formed into a one-piece sealing means generally indicated by the reference character 210. More particularly, peripheral side walls 130 and 136, and flange 128, have, in effect, been integrally formed, and the lower wall 132 of member 126 has been eliminated. The resulting one-piece, inverted cup-shaped member 212, having a blind, annular recess 214 defined within the upper portion thereof for accommodating the lower end of container 114, is a substantially simplified version of the sealing means 110 of FIGS. 2 and 3.

Obviously, many modifications and variations of the present invention are possible in light of the teachings noted hereinabove. It is therefore to be understood that within the scope of the appended claims, the present invention may be practiced otherwise than as specifically described herein.

What is claimed as new and desired to be secured by Letters Patent of the United States is:

1. A sealing device for closing an open end of a hollow, tubular member comprising:

three-point, plug type sealing means, mounted upon an open end of a hollow, tubular member, for engaging at least two primary surfaces of said tubular member and thereby closing said open end thereof;

said sealing means comprising a first, inverted cup-shaped member having an inverted substantially U-shape in cross-section, and a second cup-shaped member having a portion substantially U-shaped in cross-section housing said first member therewithin;

said first inverted member having a radially outwardly projecting annular flange means radially spacing the peripheral side wall of said first member from the peripheral side wall of said second member for defining an annular recess within which said open end of said tubular member is disposed for enhancing the sealing characteristics of said sealing means; and said tubular member being seated within said recess and in frictional contact with said peripheral side wall of said first member and said peripheral side wall of said second member, said annular recess having a width substantially equal to the thickness of the wall of said tubular member, said wall of said tubular member being beadless.

2. The sealing device as set forth in claim 1, wherein:

said sealing means including a plurality of annular ridges defined upon the inner peripheral surface of said second member for cooperating with said flange means of said first member.

3. The sealing device as set forth in claim 2, further comprising:

supporting means for supporting said container in an upstanding mode.

4. The sealing device as set forth in claim 3, wherein:

said supporting means comprises a frusto-conical skirt.

5. The sealing device as set forth in claim 1, wherein said means for enhancing the sealing characteristics defines a snap-fit between said first and second members.

* * * * *